United States Patent [19]

Tassie et al.

[11] 4,215,620

[45] Aug. 5, 1980

[54] IGNITION DEVICE

[75] Inventors: Douglas P. Tassie, St. George, Vt.; Robert A. Pustell, Andover, Mass.

[73] Assignee: General Electric Company, Burlington, Vt.

[21] Appl. No.: 849,736

[22] Filed: Nov. 9, 1977

Related U.S. Application Data

[62] Division of Ser. No. 723,367, Sep. 15, 1976, Pat. No. 4,085,653.

[51] Int. Cl.[2] ..... F42B 33/10

[52] U.S. Cl. ..... 86/1 R; 102/46; 174/102 P; 89/7

[58] Field of Search ..... 174/102 P, 118; 89/7; 102/38 R, 46; 86/1 R

[56] References Cited

U.S. PATENT DOCUMENTS

| | | | |
|---|---|---|---|
| 2,341,235 | 2/1944 | Palmer | 174/102 P |
| 2,657,248 | 10/1953 | Smits | 174/118 X |
| 3,056,576 | 10/1962 | Haefner | 102/46 X |
| 3,724,383 | 4/1973 | Gallaghan | 102/46 |
| 3,754,506 | 8/1973 | Parker | 102/46 |
| 3,763,739 | 10/1973 | Tassie | 89/7 |

*Primary Examiner*—Harold J. Tudor
*Attorney, Agent, or Firm*—Bailin L. Kuch

[57] ABSTRACT

An igniter assembly for use in liquid propellant guns comprises an outer tubular conductor and an inner conductor spaced apart by a volume of tightly packed, irregular granules of an insulating material, such as a mineral powder. The outer conductor is supported in a longitudinal bore of a gun bolt.

7 Claims, 1 Drawing Figure

IGNITION DEVICE

RELATED PATENTS

This application is a division of Ser. No. 723,367 filed Sept. 15, 1976, and issued on Apr. 25, 1978 as U.S. Pat. No. 4,085,653.

BACKGROUND OF THE INVENTION

1. Field of the Invention

This invention relates to ignition devices for use in a high mechanical shock environment, such as the ignition of liquid propellant in a gun, or the ignition of fuel in a jet engine.

2. Prior Art

The use of an igniter, per se, in a liquid propellant gun is shown by Broussard in U.S. Pat. No. 2,088,503, issued July 27, 1937; Rost in U.S. Pat. No. 2,129,875, issued Sept. 13, 1938; Barbieri et al in U.S. Pat. No. 3,326,084, issued June 20, 1967; Myers in U.S. Pat. No. 3,673,917, issued July 4, 1972; Nelson et al in U.S. Pat. No. 3,728,937, issued Apr. 24, 1973; Tassie in U.S. Pat. No. 3,763,739, issued Oct. 9, 1973; and Broxholm et al in U.S. Pat. No. 3,949,642, issued Apr. 13, 1976. Of these, Tassie and Broxholm et al show the igniter coaxially mounted in the gun bolt, as does Mitchell in U.S. Pat. No. 3,608,492, issued Sept 28, 1971 in a gun firing caseless ammunition.

The conventional igniter is an assembly of solid, rigid parts. The main insulator is usually a hard, high-fire ceramic, which is then combined with seals and fitted inside a strong, outer case which also serves as the outer conductor or electrode. The center electrode together with seals is fitted through a longitudinal bore in the main insulator. In a high mechanical shock environment, i.e., high pressure pounding, the assembly deteriorates; the seals deteriorate; the ceramic cracks, or one part slips with respect to another. Such slippage causes more breakage; the seal fails, combustion gas leaks, and eventually the igniter even fails to spark.

Accordingly, it is an object of this invention to provide an igniter which is unaffected by a high mechanical shock environment.

An additional object of this invention is to provide a gun bolt and igniter assembly which is effective in a liquid propellant gun.

Another object of this invention is to provide a process for the manufacture of such an igniter.

A feature of this invention is the provision of an igniter assembly comprising an outer tubular conductor and an inner conductor spaced apart by a volume of tightly packed, irregular granules of an insulating material, such as a mineral powder. The outer conductor is supported in a longitudinal bore of a gun bolt.

BRIEF DESCRIPTION OF THE DRAWING

These and other objects, advantages and features of the invention will be apparent from the following specification thereof taken in conjunction with the accompanying drawing in which.

DESCRIPTION OF THE EMBODIMENT

Figure 1:
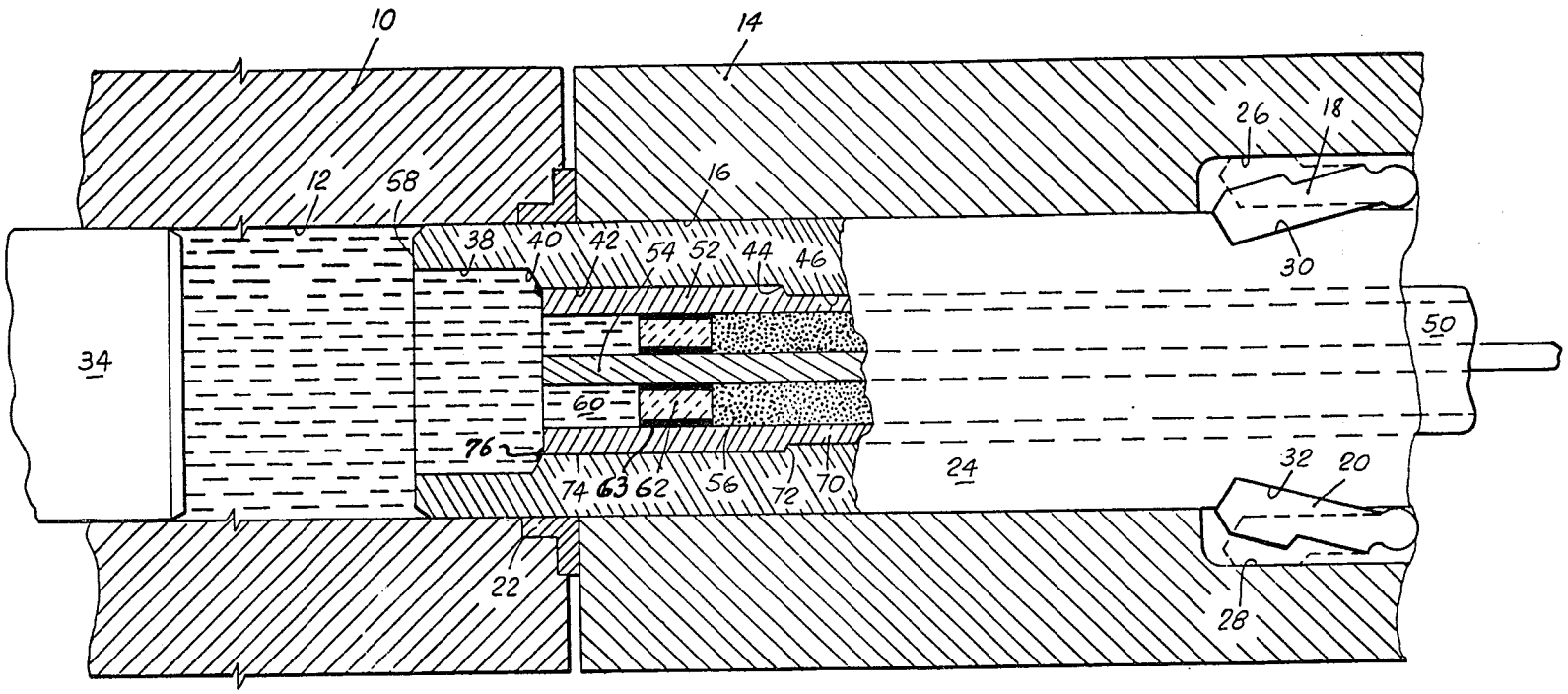
FIG. 1 is a top plan view, in longitudinal cross-section through the gun bolt, of a liquid propellant gun utilizing an ignition device embodying this invention.

A liquid propellant gun, for example, as is shown in the FIGURE, comprises a gun barrel 10 having a bore 12, a breech 14 having a bore 16 and a pair of swinging lock blocks 18 and 20, an annular seal 22 at the interface of the barrel and the breech, and a gun bolt 24. The gun bolt reciprocates in the bore 16 and enters and obturates the bore 12. The bolt is locked in its obturating station by the lock blocks 18 and 20 which may be swung between the recesses 26 and 28 in the breech and the recesses 30 and 32 in the bolt. A projectile 34 may be chambered in the bore 12 and a supply of liquid propellant may be inletted into the chamber between the projectile and the bolt. An exemplary system is shown in Tassie, U.S. Pat. No. 3,763,739.

The gun bolt has a longitudinal bore therethrough having a first portion 38, a shoulder 40, a second portion 42 of smaller diameter than said first portion, a shoulder 44, and a third portion 46 of smaller diameter than said second portion.

An igniter 50 is fixed within the bore of the gun bolt. The igniter comprises an outer tube 52, an inner rod 54, a volume 56 of irregular tightly packed together particles spacing the rod concentrically within the tube, except proximal to the face 58 of the bolt, wherein a void 60 to serve as a spark chamber is provided between the tube 52 and the rod 54. An annulus 62 may be fixed within the void to close the exposed end face of the volume of particles. In an exemplary igniter, the tube 52 is made of a relatively workable, conductive material such as 321 stainless steel, the rod 54 is made of 303 stainless steel wire, (both chosen for corrosion resistance) and the insulating material 56 is magnesium oxide powder (MgO). The annulus 62 is a hard fired ceramic bead. The seals 63 around the annulus 62 are made of a resilient material which is not soluble in the particular propellant or fuel which is to be ignited, e.g., fluorocarbon elastomer.

The igniter 50 is advantageously manufactured by compression techniques. In using a rotary swaging technique, the rod 54 is initially positioned within the empty tube 52. The insulating powder 56 is poured into the tube and is either tamped or vibrated to a light degree of compaction. Alternatively, the rod 54 may be threaded into a number of crushable MgO beads, and this assembly slid into the empty tube 52. The ends of the filled tube 52 are then closed, as by plugs or welding, to prevent the powder and wire from being forced out of the tube during subsequent compaction. The closed assembly of tube, rod and powder is fed into a set of rotating dies between hammers in a cage. As the dies rotate, they open and close on the tube to reduce its external diameter. The first pass collapses and eliminates all internal voids. Successive passes further reduce the diameter and increase the length of the assembly by the formula $V_1=V_2$ where $V_1$=volume before the pass and $V_2$=volume after the pass, and $\pi R_1^2L_1=\pi R_2^2L_2$. In essence, the tube and its internal parts are concurrently squeezed out from between the die. As an alternative to rotary swaging, drawing, rolling, press swaging, or plain hammering on an anvil die could be used.

After compaction, the aft portion 70 of the tube 52 is machined to reduce its external diameter and to produce a step or shoulder 72 which is congruent with the shoulder 44, and the plugged ends are removed. The forward or pressure or chamber portion 74 of the tube 52 tightly fits into the bore postion 42 while the aft portion 70 loosely fits into the bore portion 46 and is brazed therein. The shoulders 72 and 44 are in tight abutment. The chamber end of the tube is welded at 76 (e.g. fusion process) to the shoulder 40 of the gun bolt.

The essential characteristic of the insulating powder is that it must be so tightly compressed by the outer tube 54 that there is no space left for any particle of that powder or for any part of any other element of the assembly to shift into under any pressure applied during use of the igniter. MgO was selected because it has good physical and dielectric properties at high temperature, and because its irregular particles interlock together and into the adjacent metal surfaces under swaging better than any other material presently known. Other metal oxide mineral dielectric material may be used.

The void 60 is provided by air blasting out a quantity of particles from the chamber end of the igniter to expose a length of the exterior surface of the inner conductor and interior surface of the outer tube to act as electrodes.

This process of manufacture of collapsing the outer tube about the loose powder and the center conductor so tightly that everything is interlocked and cannot move irrespective of externally applied pressure, provides an assembly which behaves as if it were a solid rod of metal having the handling characteristics of the outer tube. Thus, pressure pulses beating on the forward face of the igniter cannot in any way disturb any of the parts of the igniter unless the outer tube expands, thereby loosening the powder. The gun bolt tightly fits around the igniter and supports it as a sheath both radially and longitudinally.

The annulus 62 does not fail under pressure pulses because it is firmly and evenly supported by the compacted powder 56 in the direction of the force, i.e. longitudinally, of the pulses. In all other directions the force of the pulses is simultaneously equal, and subjects the annulus only to a compressive stress which it can easily withstand.

The function of the annulus 62 and its seals is to prevent contaminants within the combustion chamber from entering the chamber face of the volume of powder.

It may be noted that the manufacturing process of this invention is quite different than conventionally used in making dielectric powder filled conduit. In the manufacture of conduit there is a step to soften the powder in the conduit so that it will flow with respect to the inner and outer conductors when the conduit is bent, and a step to anneal the outer conductor. In contradistinction, the igniter of this invention must be rigid and permit no relative movement of its internal elements. The pressure pulses apply extremely high pressure on the surface and interior interfaces of the volume of powder. No give or movement of the outer tube or internal elements is permitted. In the conventional conduit there is no pressure on the surface or interior interfaces of the powder in the tube.

It should be noted that the invention herein is not limited to a single inner conductor, a plurality of mutually spaced apart conductors may be supported by the particles of dielectric material and held by the outer tube.

What is claimed is:

1. A process for the manufacture of an igniter comprising:

providing an assembly of an outer tube of conductive metal, an inner rod of a conductive metal, and an intermediate volume of irregular particles of metal oxide mineral dielectric material spacing said rod within said tube;

compressing and reducing the diameter of the outer tube radially about said intermediate volume and the rod to remove all voids in said intermediate volume and to interlock and imbed said particles of said intermediate volume with each other and the adjacent metal surfaces of said rod and said tube; and removing a portion of said volume after said compressing step to provide a spark chamber wherein a portion of said inner rod is exposed to a portion of said outer tube.

2. A process according to claim 1 wherein:

said compressing step reduces the diameter and increases the length of said assembly.

3. A process according to claim 1 further including:

removing a portion of said volume after said compressing step to provide a spark chamber wherein a portion of said inner rod is exposed to a portion of said outer tube.

4. A process according to claim 1 further including:

fixing an end portion of said assembly which includes said spark chamber within an additional tube to provide additional radial support to said outer tube.

5. A process for the manufacture of an igniter comprising:

providing an assembly of an outer tube of conductive metal, an inner rod of a conductive metal, and an intermediate volume of irregular particles of metal oxide mineral dielectric material spacing said rod within said tube;

compressing and reducing the diameter of the outer tube radially about said intermediate volume and the rod to remove all voids in said intermediate volume and to imbed the peripheral particles of said volume into the adjacent surfaces of said tube and rod; and removing a portion of said volume after said compressing step to provide a void at a first end of said volume, said void being defined by an exposed portion of said inner rod mutually confronting an exposed portion of said outer tube, and the end face of said volume.

6. A process according to claim 5 further including:

fixing said igniter into an additional tube to provide additional radial support to said outer tube.

7. A process according to claim 6 further including:

providing mutual interlocking shoulders on the exterior of said outer tube and the interior of said additional tube to preclude relative movement in one longitudinal direction.

* * * * *